US005904097A

United States Patent [19]

Nishi

[11] Patent Number: 5,904,097

[45] Date of Patent: May 18, 1999

[54] CLAMPING APPARATUS OF A PLATE FOR A PRINTING MACHINE

[75] Inventor: Hidekazu Nishi, Fuchu, Japan

[73] Assignee: Ryobi Ltd., Hiroshima-ken, Japan

[21] Appl. No.: 08/994,077

[22] Filed: Dec. 19, 1997

[30] Foreign Application Priority Data

Jan. 9, 1997 [JP] Japan ..... 9-001876

[51] Int. Cl.[6] ..... B41F 27/12

[52] U.S. Cl. ..... 101/415.1

[58] Field of Search ..... 101/409, 410, 101/415.1, 477

[56] References Cited

U.S. PATENT DOCUMENTS

| | | | |
|---|---|---|---|
| 3,017,830 | 1/1962 | Penner | 101/415.1 |
| 3,110,255 | 11/1963 | Jeschke et al. | 101/415.1 |
| 3,460,443 | 8/1969 | Sarka et al. | 101/415.1 |
| 3,946,670 | 3/1976 | Cerny et al. | 101/415.1 |
| 3,976,005 | 8/1976 | Kaufmann | 101/415.1 |

*Primary Examiner*—Edgar Burr
*Assistant Examiner*—Leslie Grohusky
*Attorney, Agent, or Firm*—Merchant, Gould, Smith, Edell, Welter & Schmidt

[57] ABSTRACT

A plurality of spring bases 50, 51 and 52 are provided to a tail edge side clamping base 76 independently. A pair of base convexes 51T are formed on both an upper surface and a lower surface of the spring base 51. A tension selecting part 70 comprising a first block 72 having a pair of block convexes 72T is provided at a position confronted with the spring base 51. The block convexes 72T and the base convexes 51T are contacted with each other by moving a lever 72L formed on an upper surface of the first block 72 when the plate 15 is fitted tightly on a cylinder surface of a plate cylinder 60 with low tension. The lever 72L is moved either in a direction of the arrow 100 or 101 when the plate 15 is fitted tightly on the cylinder surface of the plate cylinder 60 with high tension.

9 Claims, 14 Drawing Sheets

Fig.12
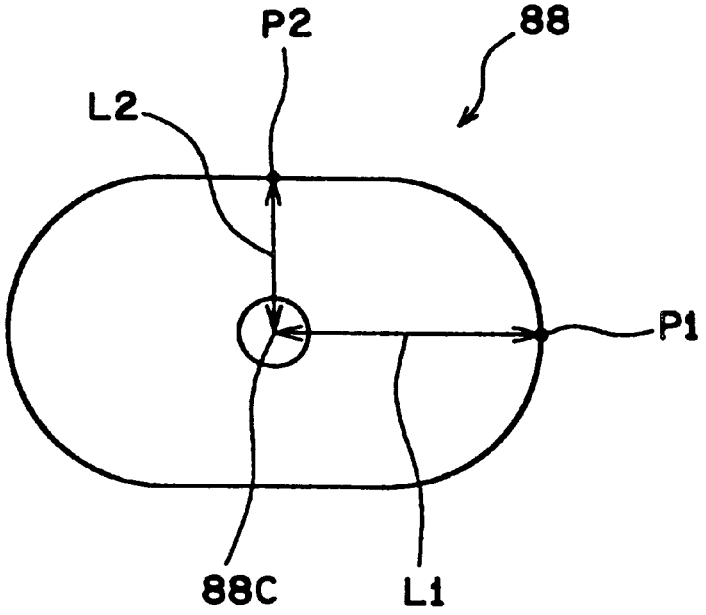
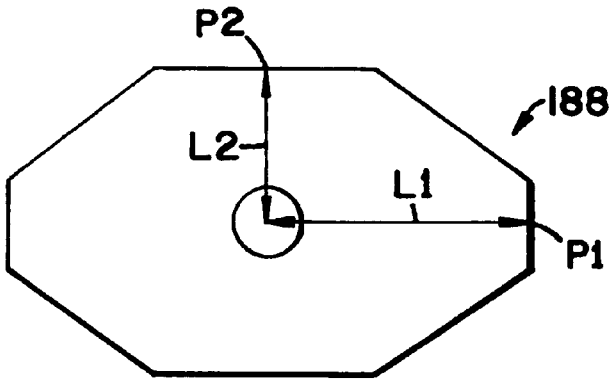
FIG.15

<PRIOR ART>

<PRIOR ART>

CLAMPING APPARATUS OF A PLATE FOR A PRINTING MACHINE

CROSS-REFERENCE TO RELATED APPLICATIONS

This application is based on Application No. Hei 9-1876 filed on Jan. 9, 1997 in Japan, the content of which is incorporated hereinto by reference.

BACKGROUND OF THE INVENTION

1. FIELD OF THE INVENTION

The present invention relates to structure of a clamping apparatus of a plate for a printing machine, and more specifically, to a clamping apparatus for a plate for a printing machine which can apply adequate tension to the plate depending on the materials of the plate.

2. DESCRIPTION OF THE PRIOR ART

Generally, in order to carry out printing with offset printing machines, an adequate amount of ink and dampening solution are supplied to a plate which is rolled around a plate cylinder and fitted thereon. A clamping apparatus is used for fitting the plate tightly on a cylinder surface of the plate cylinder. The plate is fitted on the cylinder surface of the plate cylinder to prevent a shear in printing or other failures in printing when the plate is not fitted tightly on the cylinder surface.

The structure and operation of conventional clamping apparatuses is described hereunder.

FIG. 13 is a sectional view showing a clamping apparatus 80 for fitting a plate on the cylinder surface of the plate cylinder. One edge (a leading edge side) of the plate 15 is clamped on the plate cylinder 30, and then the plate 15 is rolled around the cylinder surface of the plate cylinder 30. Thereafter, the other edge (a tail edge side) of the plate 15 is clamped by a clamping unit 20 provided on the tail edge side 35 of the plate cylinder 30. A plurality of adjustment bolts 22 are screwed into the clamping unit 20 in the same direction as a shaft of the plate cylinder 30. The clamping unit 20 is moved in the direction of arrow 200 as a result of pointed ends 22S of the adjustment bolts 22 contacting inner wall 30S of the tail edge side 35 when the adjustment bolts 22 are screwed into the clamping unit 20 to a certain depth.

In this way, the plate 15 clamped by the clamping unit 20 is pulled in the direction of the arrow 200 and the plate 15 is fitted on the cylinder surface of the plate cylinder 30. As indicated, the plate 15 is fitted tightly on the plate cylinder by screwing each of the adjustment bolts 22. On the contrary, each of the adjustment bolts is unscrewed in order to loosen the fixture of the plate 15 on the cylinder surface of the plate cylinder 30. The fixture of the plate 15 on the cylinder surface of the plate cylinder 30 is loosened as a result of moving the clamping unit 20 in the direction of arrow 300.

Further, there is conventional clamping apparatus which uses a plurality of coil springs between a side wall formed in the plate cylinder and the clamping unit instead of the adjustment bolts 22. The plate is fitted tightly on the cylinder surface of the plate cylinder by pulling the plate as a result of moving the clamping unit with spring force of the coil springs.

In addition, another conventional clamping apparatus is shown in FIG. 14. A clamping unit 40 is provided on the tail edge side of the plate cylinder 60, and the tail edge side part of the plate 19 is clamped by the clamping unit 40. A plurality of coil springs 45 are provided between the inner wall of the plate cylinder 60 and the clamping unit 40. The clamping unit 40 which clamps the plate 19 is pushed in the direction of arrow 150 by the spring force of the coil springs 45.

Also, a stopper 28 is provided on the plate cylinder 60, and a plurality of stopper screws 38 are screwed and pass through the stopper 28. Each of the stopper screws 38 is disposed in the same direction as the shaft of the plate cylinder 60. Pointed ends of the stopper screws 38 are contacted with the clamping unit 40. In other words, movement of the clamping unit 40 in the direction of the arrow 150 is restricted by the stopper screws 38 each of which is screwed into the stopper 28.

Each of the stopper screws 38 is loosened when the plate 19 is fitted tightly on the cylinder surface of the plate cylinder 60 by using the clamping unit 160. The plate 19 is fitted tightly on the cylinder surface of the plate cylinder 60 by pulling the plate 19 which is clamped by the clamping unit 40 as a result of moving the clamping unit 40 in the direction of the arrow 150 with the spring force of the coil springs 45 and the plate 19 can be fitted more tightly on the cylinder surface of the plate cylinder 60 with certain reliability by loosening each of the stopper screws 38.

On the other hand, each of the stopper screws 38 is screwed further in order to loosen the fixture of the plate 19 on the cylinder surface of the plate cylinder 60. By doing that, however, the fixture of the plate 19 on the cylinder surface of the plate cylinder 60 is loosened as a result of moving the clamping unit 40 in the direction of the arrow 190.

The conventional clamping apparatuses described above have the following problems to be resolved. Plates for printing machines are made of several different materials such as aluminum, resins, papers and so on. It is necessary to adjust tension for fitting these plates on the cylinder surface of the plate cylinder depending on the materials of the plates.

In the clamping apparatus 80 shown in FIG. 13, the moving distance of the clamping unit 20 can be adjusted by the amount of screwing done by each of the adjustment bolts 22. As a result, the tension applied to the plate 15 can be adjusted. Although the tension can be adjusted by the clamping apparatus, each of the adjustment bolts 22 has to be screwed on a one by one basis. In this way, adjustment of the tension takes much time and much work.

However, the tension applied to the plate can not be adjusted in conventional clamping apparatus which are equipped with coil springs instead of adjustment bolts 22. The coil springs can only apply uniform tension to the clamping unit. It is not possible for the clamping apparatus to apply tension to the clamping unit depending on the materials of the plates.

For instance, a plate which requires high tension for fitting can not be fitted tightly on the cylinder surface of the plate cylinder when coil springs having lower spring force than the tension required by the plate are provided to the clamping apparatus. Insufficient tension is applied to the plate. On the other hand, a plate which requires low tension for fitting may be damaged when coil springs having higher spring force than the tension required by the plate are provided to the clamping apparatus. Too much tension is applied to the plate.

Further, tension applied to the plate 19 can be adjusted in the clamping apparatus shown in FIG. 14 because the moving distance of the clamping unit 40 is adjusted by the amount of screwing done by each of the stopper screws 38.

Although, the tension can be adjusted by the clamping apparatus, each of the stopper screws 38 has to be screwed on a one by one basis. In this way, adjustment of the tension to the plate 19 takes much time and much work similar to the clamping apparatus 80 shown in FIG. 13.

OBJECTS AND SUMMARY OF THE INVENTION

It is an object of the present invention to provide a clamping apparatus for a plate for a printing machine which can provide adequate tension easily and quickly to the plate depending on the materials of the plate.

In accordance with the present invention, a clamping apparatus for a plate for a printing machine comprises:

- a first clamping part provided to a plate cylinder and fixing a first edge of the plate,
- a second clamping part provided to the plate cylinder and fixing a second edge of the plate, the plate being rolled around a cylinder surface of the plate cylinder and the first edge thereof being fixed by the first clamping part, wherein the second clamping part includes a holding part which holds the second edge of the plate,
- a plurality of pushing parts which push the holding part, the pushing parts pushing the holding part independently so as to move the holding part in a tensioning direction to close the plate with the cylinder surface of the plate cylinder, and
- a switching part which limits the pushing force of the pushing parts to the holding part or releases the limitation of the pushing force.

While the novel features of the invention are set forth in a general fashion, both as to organization and content, the invention will be better understood and appreciated, along with other objections and features thereof, from the following detailed description taken in conjunction with the drawings.

BRIEF DESCRIPTION OF THE DRAWINGS

FIG. 12 is an enlarged plan view of a rotary oval plate used in the third embodiment.

FIG. 15 is an enlarged plan view of a rotary polygonal plate.

DESCRIPTION OF THE PREFERRED EMBODIMENT

Figure 1:
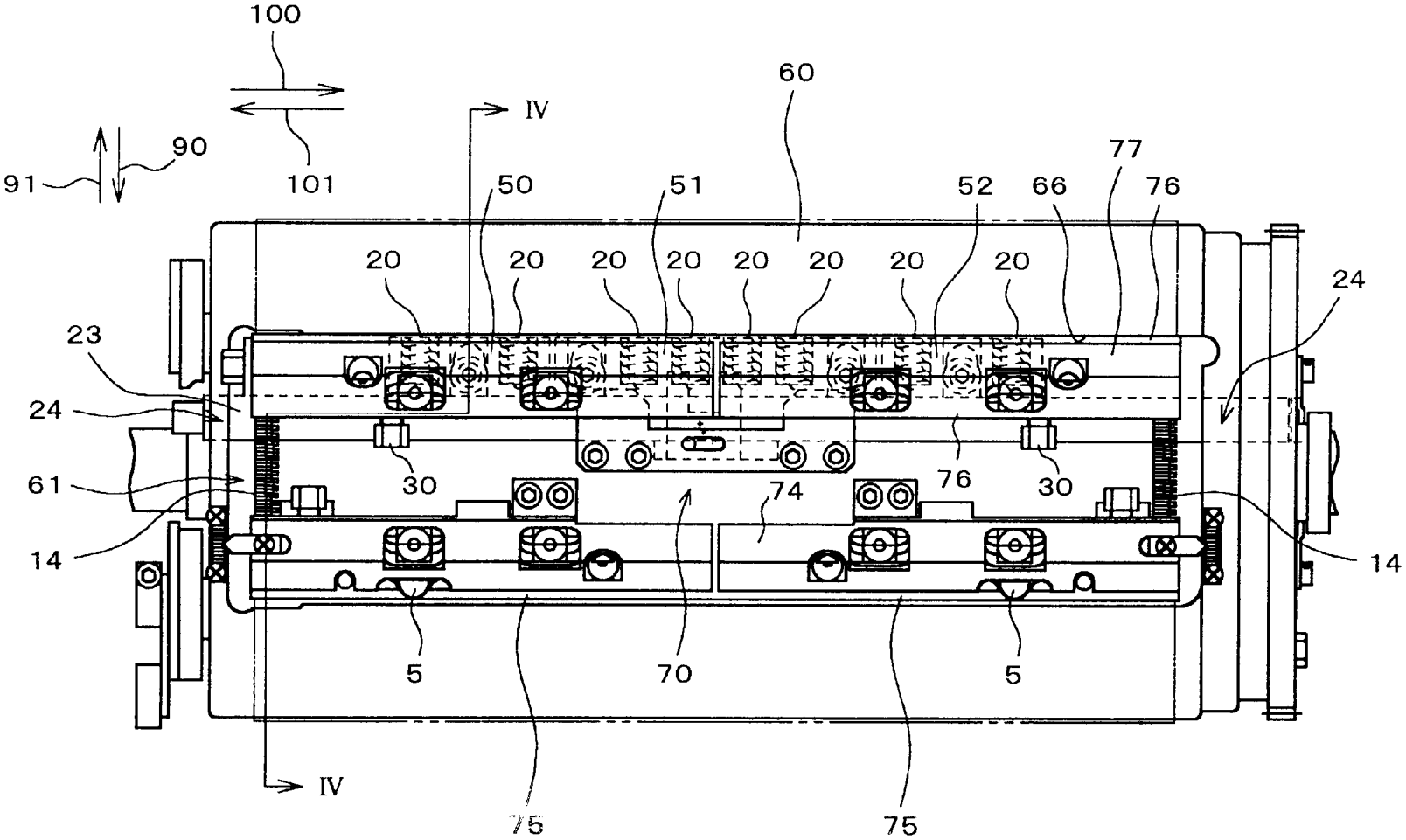
FIG. 1 is a plan view of a plate cylinder showing the first embodiment of a clamping apparatus of a plate for a printing machine in the present invention.
Figure 2:
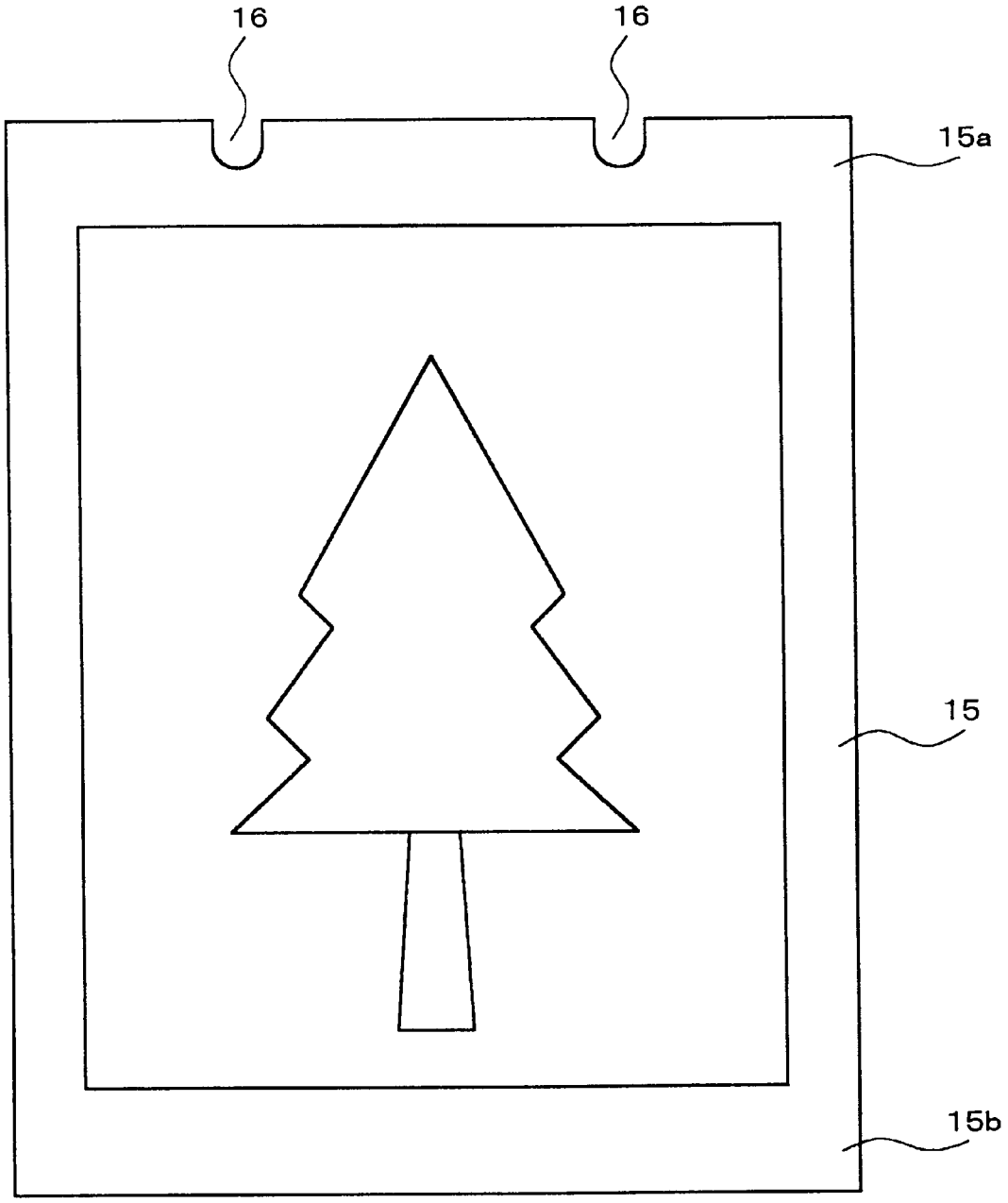
FIG. 2 is a plan view showing the plate.
Figure 3:
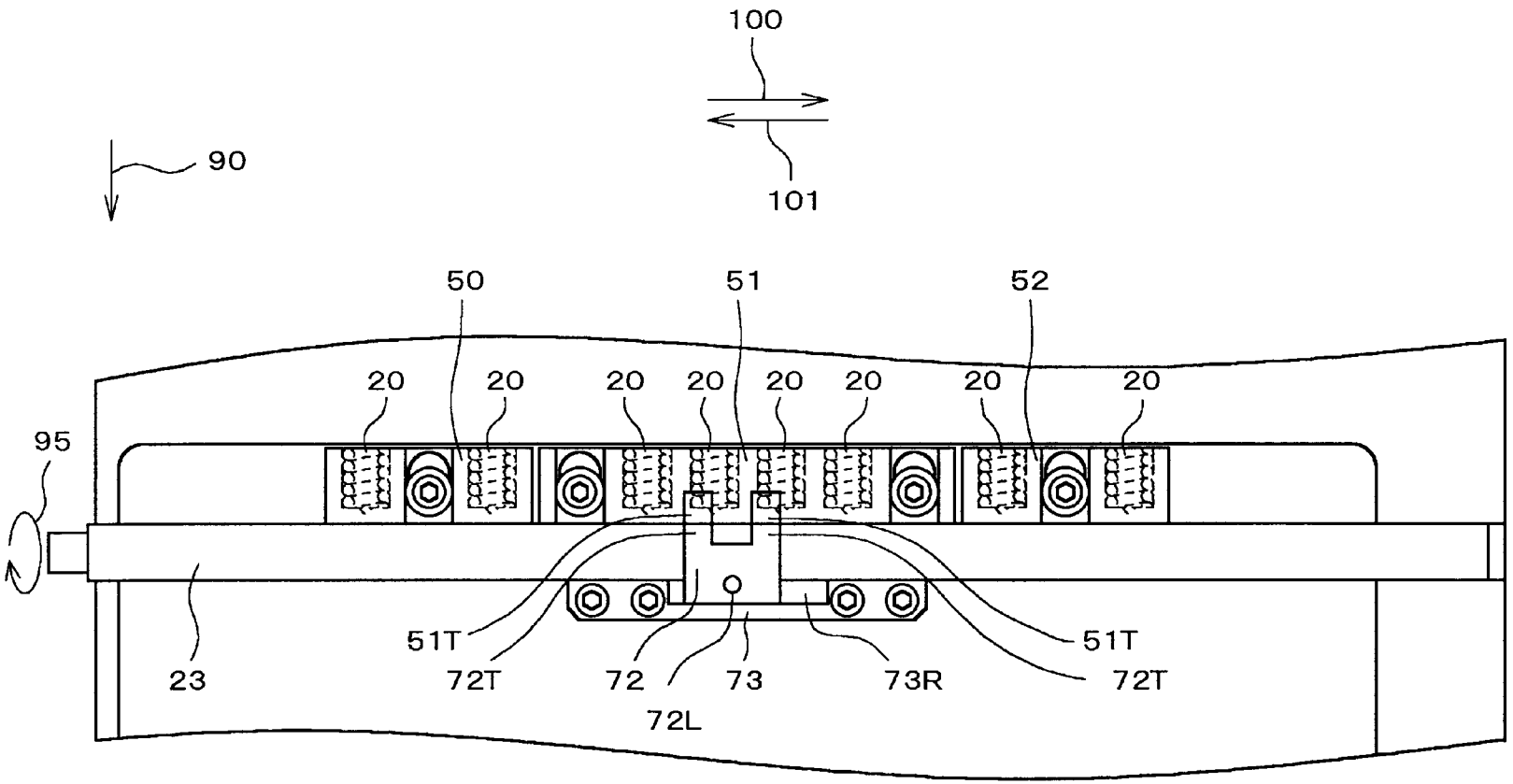
FIG. 3 is a partial plan view showing the first embodiment of the clamping apparatus shown in FIG. 1.
Figure 4:
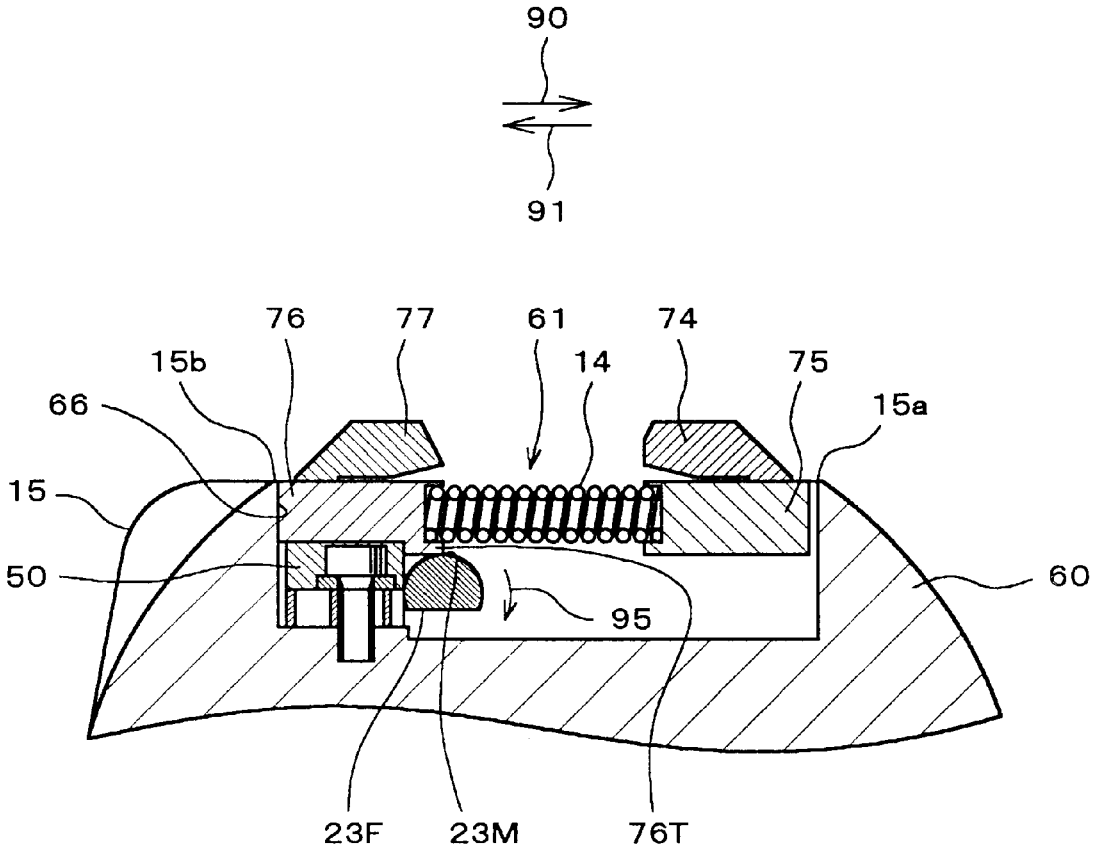
FIG. 4 is a cross sectional view in IV—IV direction of the clamping apparatus shown in FIG. 1.
Figure 5:
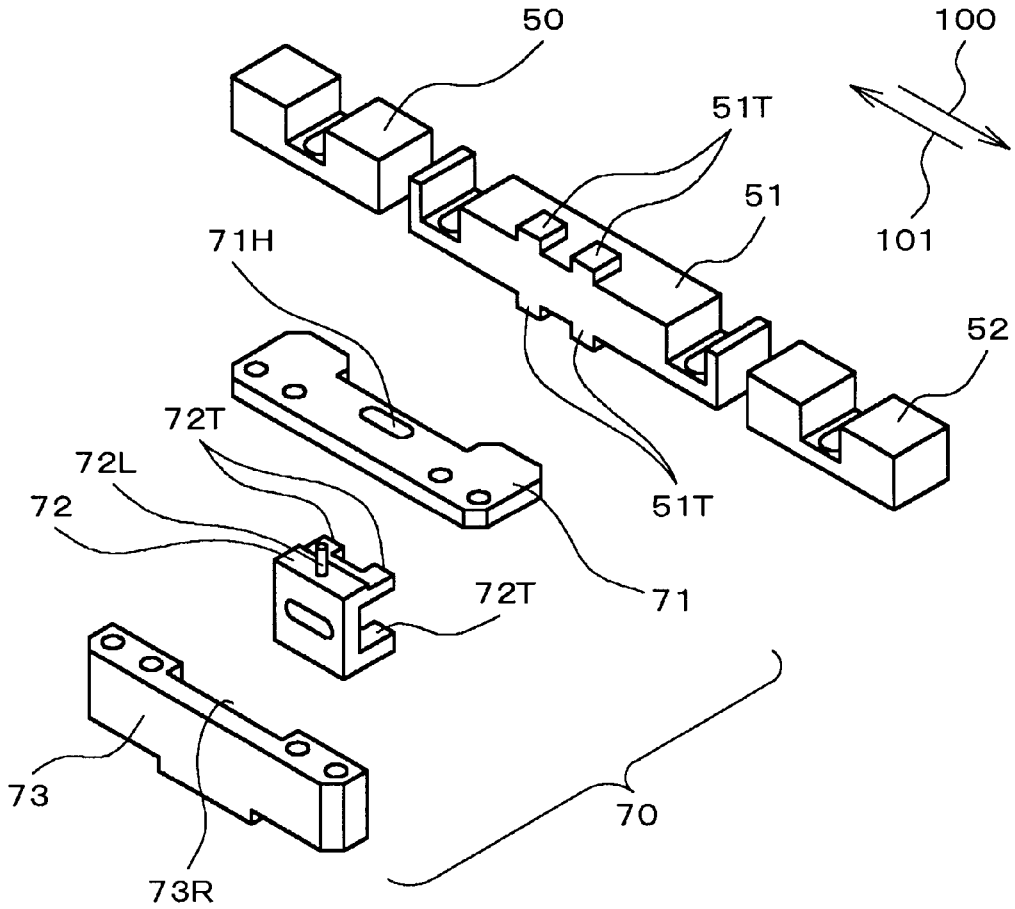
FIG. 5 is an exploded cross sectional view of a part of the clamping apparatus shown in FIG. 1.

An embodiment of a clamping apparatus of a plate for a printing machine in the present invention will be described with reference to the drawings. FIG. 1 is a plan view of a plate cylinder 60 of a printing machine providing a clamping apparatus described in this embodiment. FIG. 2 is a plan view showing the plate 15. Also, FIG. 3 is a plan view showing the first embodiment of the clamping apparatus shown in FIG. 1. FIG. 4 is a cross sectional view in the IV—IV direction of the clamping apparatus shown in FIG. 1. FIG. 5 is an exploded cross sectional view of a part of the clamping apparatus.

Figure 6:
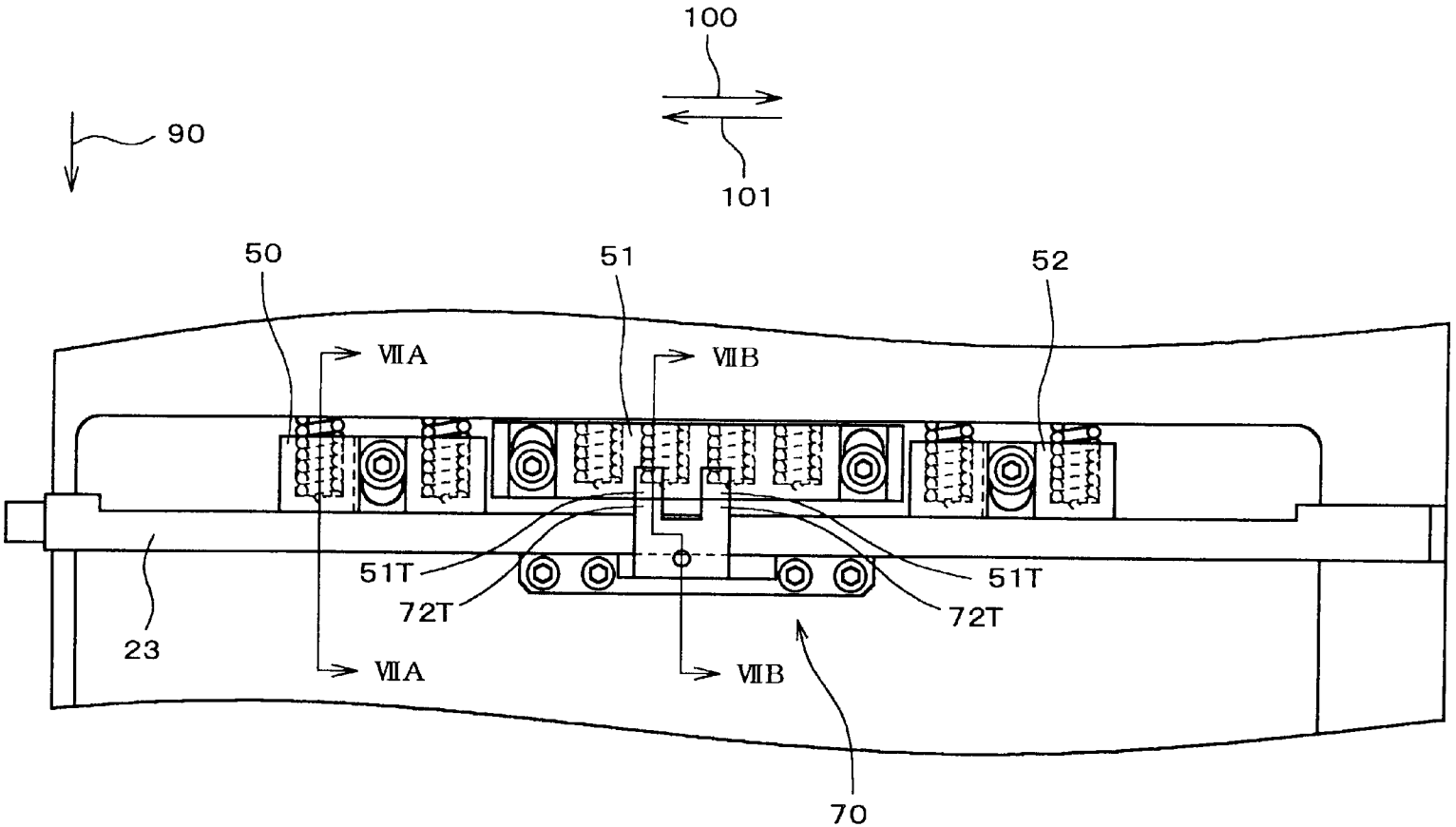
FIG. 6 is a plan view showing a condition that movement of some of the spring bases is restricted by the clamping apparatus shown in FIG. 1.
Figure 7A:
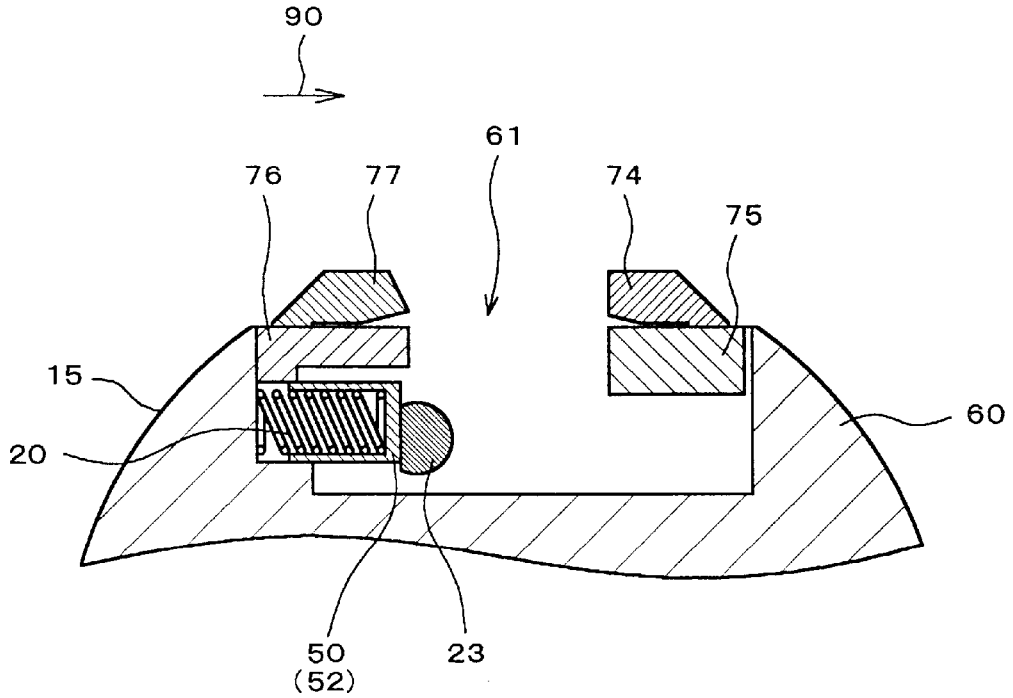
FIG. 7A is a cross sectional view in VIIA—VIIA direction of the clamping apparatus shown in FIG. 6.
Figure 7B:
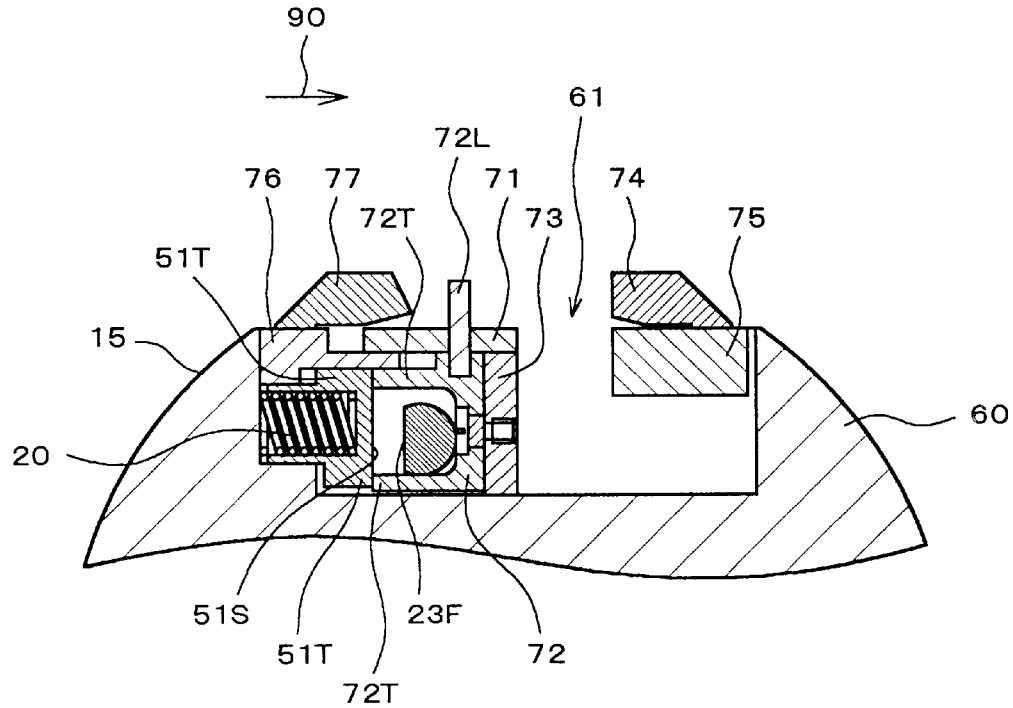
FIG. 7B is a cross sectional view in VIIB—VIIB direction of the clamping apparatus shown in FIG. 6.
Figure 8A:
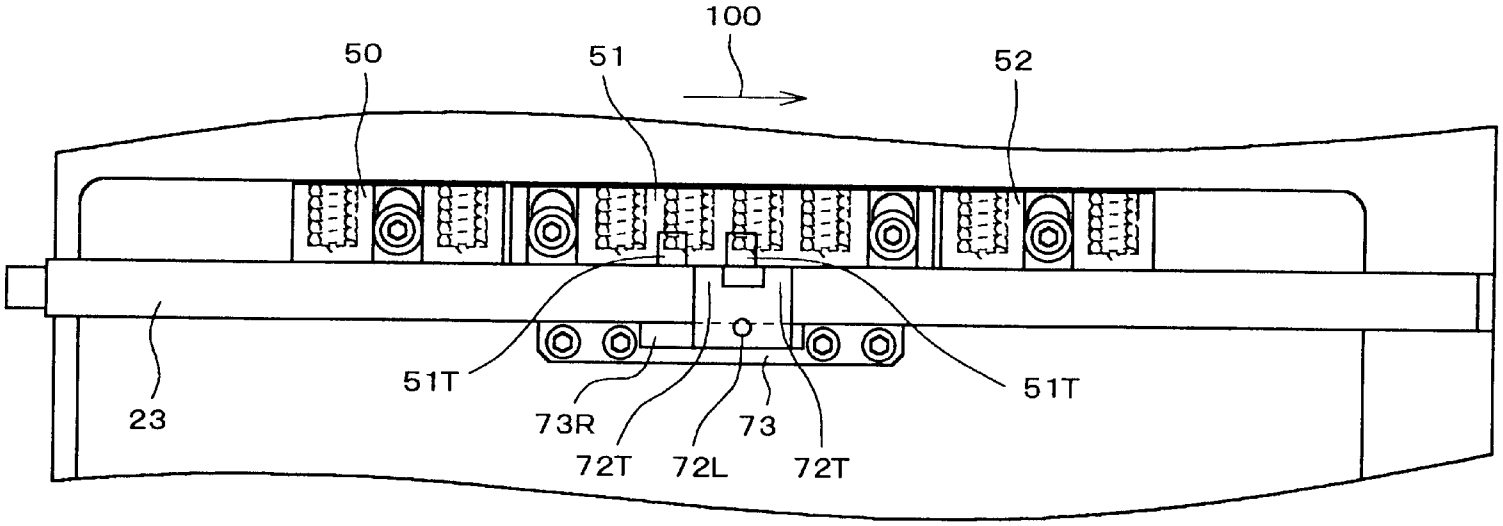
FIG. 8A is a plan view showing a condition that the movement of some of the spring bases is allowed by the clamping apparatus in the first embodiment.
Figure 8B:
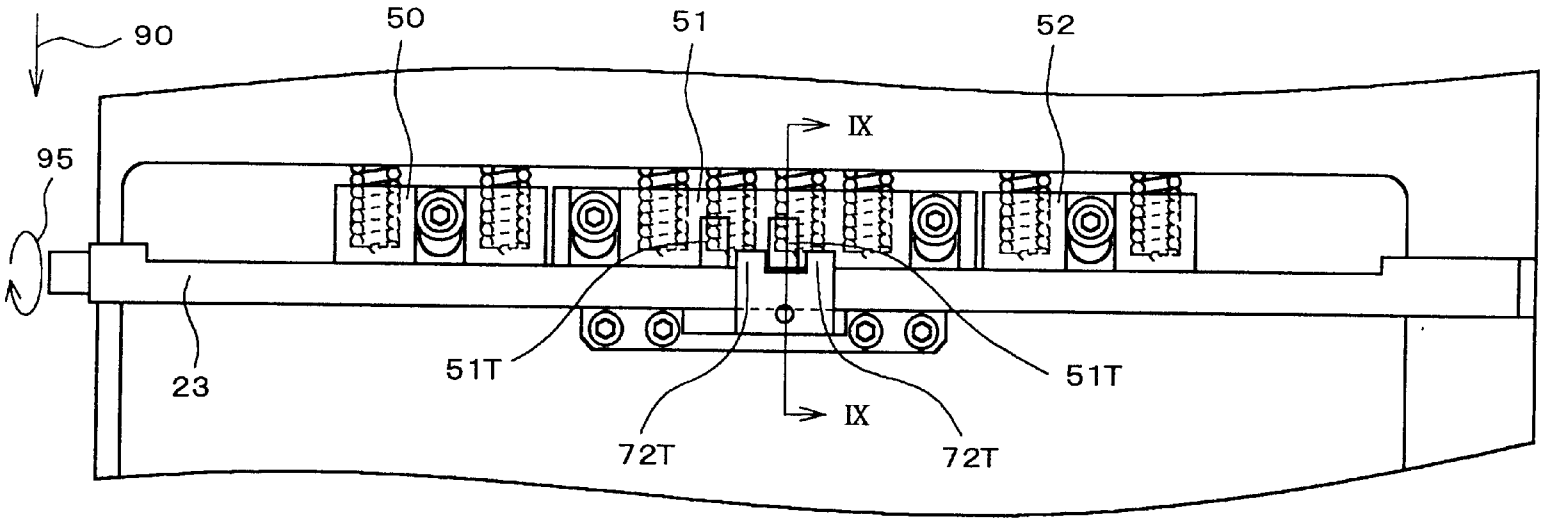
FIG. 8B is a plan view showing a condition that the movement of some of the spring bases is allowed by the clamping apparatus in the first embodiment.
Figure 9:
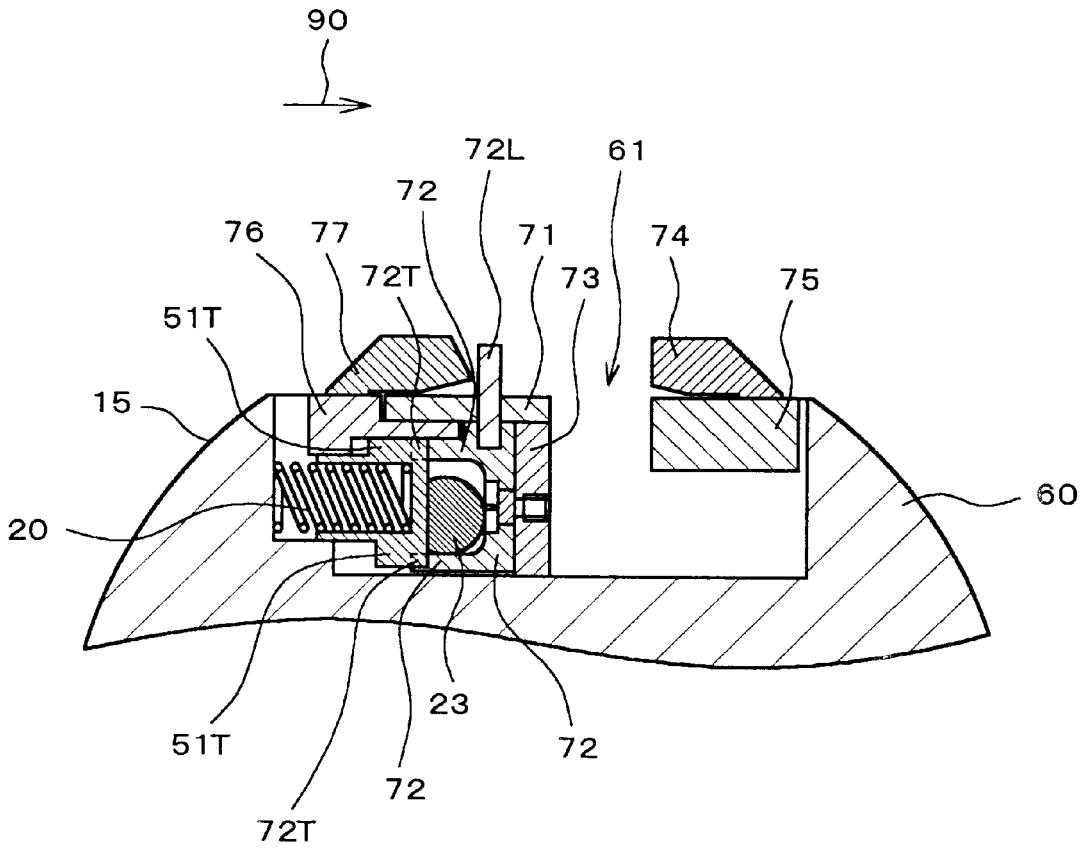
FIG. 9 is a cross sectional view in IX—IX direction of the clamping apparatus shown in FIG. 8B.

FIG. 6 is a plan view showing a condition that movement of some of the spring bases is restricted by the clamping apparatus in this embodiment. FIG. 7A is a cross sectional view in the VIIA—VIIA direction of the clamping apparatus shown in FIG. 6. FIG. 7B is a cross sectional view in the VIIB—VIIB direction of the clamping apparatus shown in FIG. 6. Both FIG. 8A and FIG. 8B are plan views showing conditions that the movement of some of the spring bases is allowed by the clamping apparatus in the first embodiment. FIG. 9 is a cross sectional view in the IX—IX direction of the clamping apparatus shown in FIG. 8B.

As shown in FIGS. 1 and FIG. 4, a cut-out part 61 is formed on the plate cylinder 60, and both a leading edge side clamping base 75 and a tail edge side clamping base 76 are provided in the cut-out part 61. Also, a leading edge side clamp 74 is provided at a position upward of the leading edge side clamping base 75. Both of the leading edge side clamping base 75 and the leading edge side clamp 74 correspond to the first clamping part in this embodiment.

Further, a tail edge side clamp 77 is provided at a position upward of the tail edge side clamping base 76. Both of the tail edge side clamping base 76 and the tail edge side clamp 77 correspond to the holding part in this embodiment.

A pair of coil springs 14 are positioned between the leading edge side clamping base 75 and the tail edge side clamping base 76. Both the leading edge side clamping base 75 and the tail edge side clamping base 76 are pushed by the coil springs 14 in both directions of arrow 90 and arrow 91 respectively.

As shown in FIG. 1, positioning pins 5 are provided at both ends of the leading edge side clamping base 75 respectively. Positioning of the plate is carried out by engaging positioning slots 16 (FIG. 2) formed at the leading edge side part 15*a* (first edge) of the plate 15 with the positioning pins 5. The leading edge side part 15*a* of the plate 15 is clamped between the leading edge side clamping base 75 and the leading edge side clamp 74 by closing the leading edge side clamp 74. Since the structure for carrying out opening and closing of the leading edge side clamp 74 is well-known, the structure is not described herein.

On the other hand, the tail edge side clamp 77 located on the tail edge side clamping base 76 has a structure for carrying out opening and closing the same as the leading edge side clamp 74. The tail edge side part 15*b* (second edge) of the plate 15 is rolled around the cylinder surface of the plate cylinder 60 and is clamped between the tail edge side clamping base 76 and the tail edge side clamp 77. Since the structure for carrying out opening and closing of the tail edge side clamp 77 is well-known, the structure is not described herein.

As shown in FIG. 3, a plurality (a total of 3) of spring bases 50, 51 and 52 are provided at a position downward of the tail edge side clamping base 76. Also, a plurality (2 pieces) of coil springs 20 are provided within both spring bases 50 and 52 respectively, and a total of four (4) coil springs are provided within the spring base 51 located at a position so as to confront with the center of the tail edge side clamping base 76 as shown in the drawings. Each of the spring bases 50, 51 and 52 is pushed in the direction of the arrow 90 (a direction to close the plate with the cylinder surface of the plate cylinder hereinafter referred to as tensioning direction) by the pushing force of the coil springs independently from others.

The spring bases 50, 51 and 52 correspond to the pushing parts in this embodiment. Also, the spring bases 50 and 52 correspond to first adjacent pushing part and second adjacent pushing part respectively in this embodiment. Also, the spring base 51 is equivalent to the central pushing part. Each of the spring bases 50, 51 and 52 is contacted with a projection 76T formed on the tail edge side clamping base 76 (FIG. 4).

Further, a cam shaft 23 is inserted into holes 24 in the side wall formed in the plate cylinder 60 as shown in FIG. 1. The cam shaft 23 having a flat surface 23F and a circumferential surface 23M can only be rotated in a range of 90 degrees in the direction of an arrow 95 because the rotation is restricted by a part (not shown) which restricts the rotation of the cam shaft 23. The movement of the spring bases 50, 51 and 52 in the tensioning direction is limited by contact of the circumferential surface 23M with the spring bases 50, 51 and 52 in a condition shown in FIG. 4.

In addition, a tension selecting part 70 as a switching part is positioned adjacent to the center of the tail edge side clamping base 76 and is located at a position confronted with the spring base 51. FIG. 3 shows a relationship among the tension selecting part 70 and each of the spring bases 50, 51 and 52. FIG. 5 shows an exploded cross sectional view of the spring bases 50, 51 and 52 and the tension selecting part 70.

As shown in FIG. 5, the tension selecting part 70 is composed of a cap 71, a first block 72 and a second block 73. And a slot 71H is formed on the cap 71. Also, a lever 72L is mounted on the first block 72, and a pair of block convexes 72T extending toward the spring base 51 are formed at both upper end and lower end of the first block as switching part convex. Further, a block concave 73R is formed in the second block 73. On the contrary, a pair of base convexes 51T are formed on both upper surface and lower surface of the spring base 51 at the center thereof as pushing part convex.

The first block is fitted into the block concave 73R so as to be moved in both directions represented by arrow 100 and arrow 101. The cap 71 is fixed to the second block 73 so as to cover the upper surfaces of the first block 72 and the second block 73 thus assembled. A part of the lever 72L of the first block 72 comes out from the slot 71H formed in the cap 71. The second block 73 is fixed on the bottom of the cut-out part 61 of the plate cylinder 60.

The first block 72 can be moved within the block concave 73R by sliding therein when a part of the lever 72L coming out from the slot 71H is switched either in the direction of arrow 100 or arrow 101.

The second clamping part in this embodiment corresponds to the holding part, the pushing parts, and the tension selecting part 70. The holding part consists of both the tail edge side clamping base 76 and the tail edge side clamp 77. The pushing parts are composed of the spring base 50, 51, 52 and coil springs 20. And the tension selecting part 70 is assembled with the cap 71 having a slot 71H, first block 72 and second block 73.

Next, steps to fit the plate 15 tightly on the cylinder surface of the plate cylinder 60 will be described hereunder. At first, the steps to fit the plate 15 tightly on the cylinder surface with relatively low tension is described. Positioning of the plate is carried out by engaging the positioning slots 16 formed at the leading edge side part 15*a* of the plate 15 shown in FIG. 2 with the positioning pins 5 provided on the leading edge side clamping base 75. Then, the leading edge side part 15*a* of the plate 15 is clamped between the leading edge side clamping base 75 and the leading edge side clamp 74 by closing the leading edge side clamp 74.

Upon clamping the leading edge side part 15*a*, the plate 15 is rolled on the cylinder surface of the plate cylinder 60, then the tail edge side part 15*b* of the plate 15 is inserted between the tail edge side clamping base 76 and the tail edge side clamp 77. After the insertion, the tail edge side part 15*b* is clamped between the tail edge side clamping base 76 and the tail edge side clamp 77 by closing the tail edge side clamp 77. FIG. 4 shows a condition when the plate 15 is clamped between the tail edge side clamping base 76 and the tail edge side clamp 77. The movement of the spring bases 50, 51 and 52 in the direction of the arrow 90 is restricted as a result of contacting the circumferential surface 23M of the cam shaft 23 by the spring bases 50, 51 and 52. Looseness of the plate 15 is observed if the plate 15 does not fit on the cylinder surface of the plate cylinder 60 (FIG. 4).

In the case of looseness, the first block 72 is located at a position so as to confront the block convexes 72T of the first block 72 with the base convexes 51T of the spring base 51 as a result of moving the first block 72 in the direction of the arrow 101 (see FIG. 3). The cam shaft 23 is rotated in the direction of the arrow 95 (see FIG. 4) for 90 degrees from the position shown in FIG. 3. FIG. 6 shows a condition that the block convexes 72T are confronted with the base convexes 51T.

As shown in FIG. 7A, both the spring bases 50 and 52 are moved in the direction of the arrow 90 (the tensioning direction) by releasing the restriction made by the circumferential surface 23M of the cam shaft 23. On the other hand, movement of the spring base 51 in the direction of the arrow 90 is restricted by contact between the block convexes 72T of the first block 72 and the base convexes 51T of the spring base 51 as shown in FIG. 7B. A gap is formed between an end 51S of the spring base 51 and the flat surface 23F of the cam shaft 23 because they do not contact with each other. Only the tension generated by a total of four (4) coil springs provided in the spring base 50 and the spring base 52 is applied to the tail edge side clamping base 76, and the tension generated by a total of four (4) coil springs provided in the spring base 51 is not applied to the tail edge side clamping base 76.

Hence, the tail edge side clamping base 76 is pushed in the direction of the arrow 90 with relatively low tension. As described above, relatively low tension is applied to the plate 15 because the tail edge side part 15*b* of the plate 15 is clamped between the tail edge side clamping base 76 and the tail edge side clamp 77. As a result, there is no probability of causing damage or breakage of the plate 15 even when the plate 15 has lower pull strength because application of too much tension is suppressed.

Next, steps to fit the plate 15 tightly on the cylinder surface of the plate cylinder 60 by applying relatively high tension to the plate 15 will be described. In this case, the contact maintained between the block convexes 72T of the first block 72 and the base convexes 51T of the spring base 51 is released by moving the lever 72L in the direction of the arrow 100 from the condition shown in FIG. 3. In other words, both the base convexes 51T of the spring base 51 and the block convexes 72T of the first block 72 are located at positions which do not confront each other by moving the block convexes 72T in the direction of the arrow 100.

FIG. 8A shows a condition that the contact between the base convexes 51T and the block convexes 72T is released. At that time, the movement of the spring bases 50, 51 and 52 in the tensioning direction is restricted by contacting the spring bases with the circumferential surface 23M of the cam shaft 23 (see FIG. 4). Looseness of the plate 15 is observed because the plate 15 does not fit on the cylinder surface of the plate cylinder 60 as a result of restricting the movement of the spring bases 50, 51 and 52 in the direction of the arrow 90.

Upon moving the lever 72L in a direction of the arrow 100, the cam shaft 23 is rotated in a direction of the arrow 95 for 90 degrees similar to the condition shown in FIG. 4. FIG. 8B shows a condition when the cam shaft 23 is rotated 90 degrees after releasing the contact between the base convexes 51T and the block convexes 72T.

As shown in FIG. 9 (a cross sectional view in IX—IX direction of the apparatus shown in FIG. 8B), the movement of the spring base 51 in a direction of the arrow 90 is allowed because the contact between the base convexes 51T and the block convexes 72T is released. The spring base 51 is moved in a direction of the arrow 90 as shown in FIG. 9 when the cam shaft 23 is rotated for 90 degrees. In other words, the spring bases 50, 51 and 52 all of which are contacted to the projection 76T of the tail edge side clamping base 76 are moved in the tensioning direction.

As a result, relatively high tension is applied to the plate 15 because the tail edge side clamping base 76 is pushed in a direction of the arrow 90 with high tension. In this way, the plate 15 can be fitted tightly on the cylinder surface of the plate cylinder 60 reliably when the plate 15 has higher pull strength because enough tension is applied to the plate 15.

As described above, the movement of the spring base 51 toward the tail edge side clamping base 76 can either be allowed or be restricted only by switching the contact or releasing the contact between the base convexes 51T and the block convexes 72T by moving the lever 72L either in a direction of the arrow 90 or the arrow 91 in the clamping apparatus in this embodiment. Therefore, it is possible to apply easily and quickly adequate tension to the plate 15 depending on materials of the plate 15.

In addition, a pair of adjustment bolts 30 are screwed into both ends of the tail edge side clamping base 76 in the clamping apparatus in this embodiment. The tail edge side clamping base 76 is moved in a direction of the arrow 90 as a result of contacting pointed ends of the adjustment bolts 30 with an inner wall 66 of the cut-out part 61 (see FIGS. 1 and FIG. 4) when the adjustment bolts 30 are screwed into the tail edge side clamping base 76 to a certain depth. Therefore, it is possible for the clamping apparatus in this embodiment to carry out a fine adjustment of the tension to the plate 15 by using the adjustment bolts 30 similar to the conventional clamping apparatus when the fine adjustment of tension is required.

Figure 10:
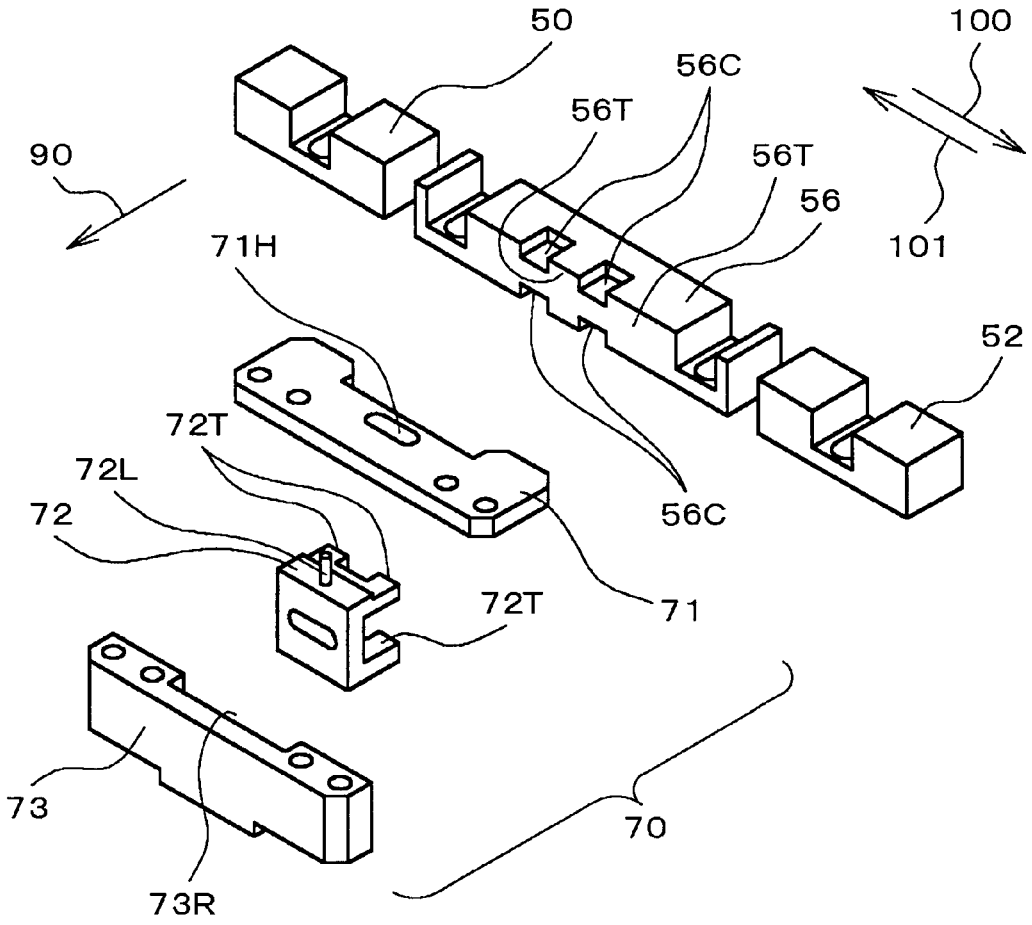
FIG. 10 is an exploded cross sectional view of a part of a clamping apparatus in the second embodiment of the present invention.

Next, the second embodiment of the clamping apparatus in the present invention will be described hereunder. FIG. 10 shows an exploded cross sectional view of the spring bases 50, 51 and 52 and the tension selecting part 70 used in this embodiment.

As shown in FIG. 10, a pair of base concaves 56C are formed on both the upper end and the lower end of the spring base 56 so as to position them at the center of the spring base 56. Further, base convexes 56T are situated between (adjacent to) the base concaves 56C. The block convexes 72T are located at a position so as to confront the block convexes 72T with the base concaves 56C as a result of moving the first block 72 in the direction of the arrow 101 within the block concave 73R. Thus, both the block convexes 72T and the base concaves 56C are in a condition to engage with each other (in a condition releasing the contact maintained between the block convexes 72T and the base convexes 56T). Other structure of the clamping apparatus in this embodiment except the features described above is the same as the clamping apparatus of the first embodiment.

The lever 72L is moved in the direction of the arrow 100 when the plate 15 is fitted tightly on the cylinder surface of the plate cylinder 60 with relatively low tension. The block convexes 72T are located at a position confronted with the base convexes 56T of the spring base 56 as a result of moving the lever 72L in the direction of the arrow 100. Thereafter, the cam shaft 23 is rotated in a direction of the arrow 95 for 90 degrees similar to the condition shown in FIG. 4.

By doing that, although both the spring bases 50 and 52 are moved in the direction of the arrow 90 by releasing the contact made with the circumferential surface 23M of the cam shaft 23, the movement of the spring base 56 in the direction of the arrow 90 is restricted by the contact maintained between the base convexes 56T and the block convexes 72T. In this way, the tail edge side clamping base 76 is pushed in the direction of the arrow 90 only by the spring bases 50 and 52 and, relatively low tension is applied to the plate 15.

On the other hand, the lever 72L is moved in the direction of the arrow 101 when relatively high tension is applied to the plate 15. Thus, both the block convexes 72T and the base concaves 56C are in a condition to engage with each other. Then, the cam shaft 23 is rotated in the direction of the arrow 95 for 90 degrees similar to the condition shown in FIG. 4.

By rotating the cam shaft 23, both the spring bases 50 and 52 are moved in a direction of the arrow 90. At the same time, the spring base 56 is moved in the direction of the arrow 90 by allowing the movement of the spring base 56 as a result of engaging the block convexes 72T with the base concaves 56C. Thus, relatively high tension is applied to the plate 15.

As described above, the movement of the spring base 56 toward the tail edge side clamping base 76 can either be allowed or be restricted by switching the contact or releasing the contact between the block convexes 72T and the base convexes 56T by moving the lever 72L either in the direction of the arrow 100 or the arrow 101 in the clamping apparatus in this embodiment similar to the first embodiment. Therefore, it is possible to apply adequate tension easily and quickly to the plate 15 depending on the materials of the plate 15.

Figure 11A:
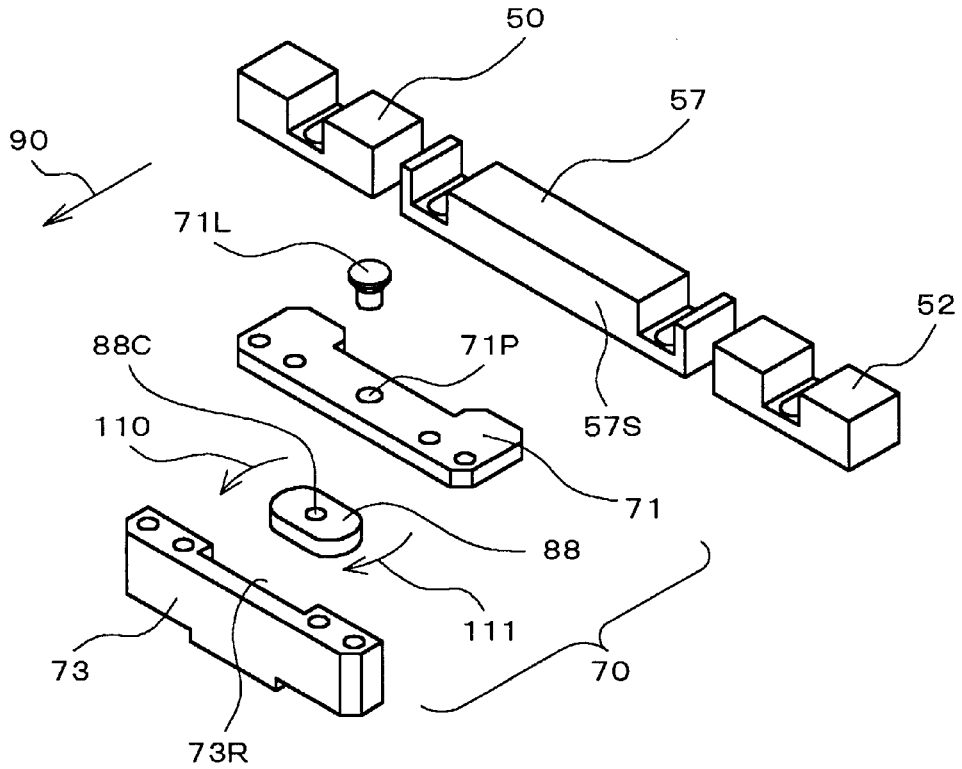
FIG. 11A is an exploded cross sectional view of a part of a clamping apparatus in the third embodiment of the present invention.

The third embodiment of the clamping apparatus in the present invention will be described hereunder. FIG. 11A shows an exploded cross sectional view of the spring bases 50, 57 and 52 and another tension selecting part 70 used in this embodiment. In this embodiment, neither of the base convexes 51T (see FIG. 5) nor the base concaves 56C (see FIG. 10) are formed on the spring base 57 unlike the first embodiment and the second embodiment. A rotary plate 88 as rotary body capable of being rotated by centering around a central point 88C is provided instead of the first block 72 in the first and the second embodiments.

FIG. 12 shows an enlarged plan view of the rotary plate 88. The rotary plate 88 is formed in semi-oval shape having a radius L1 longer than a radius L2. The radius L1 has a length which starts from the central point 88C to a point P1 as a first peripheral point, and the radius L2 has a length which starts from the central point 88C to a point P2 as a second peripheral point. A rotary lever 71L is connected to the rotary plate 88 through a mounting hole 71P formed on the cap 71.

The rotary lever 71L is rotated toward either of the directions of the arrow 110 or 111 for 90 degrees when the plate 15 is fitted tightly on the cylinder surface of the plate cylinder 60 with relatively low tension. The point P1 of the rotary plate 88 is located at a position capable of being in contact with an inner surface 57S of the spring base 57 as shown in FIG. 11B by rotating the rotary lever 71L for 90 degrees.

Thereafter, the cam shaft 23 is rotated in the direction of the arrow 90 for 90 degrees similar to the condition shown in FIG. 4. By doing that, although both the spring bases 50 and 52 are moved in the direction of the arrow 90 by releasing the contact made with the circumferential surface 23M of the cam shaft 23, the movement of the spring base 57 in the direction of the arrow 90 is restricted by the contact maintained between the point P1 of the rotary plate 88 and the spring base 57. In this way, the tail edge side clamping base 76 is pushed in the direction of the arrow 90 only by the spring bases 50 and 52 and, relatively low tension is applied to the plate 15.

Figure 11B:
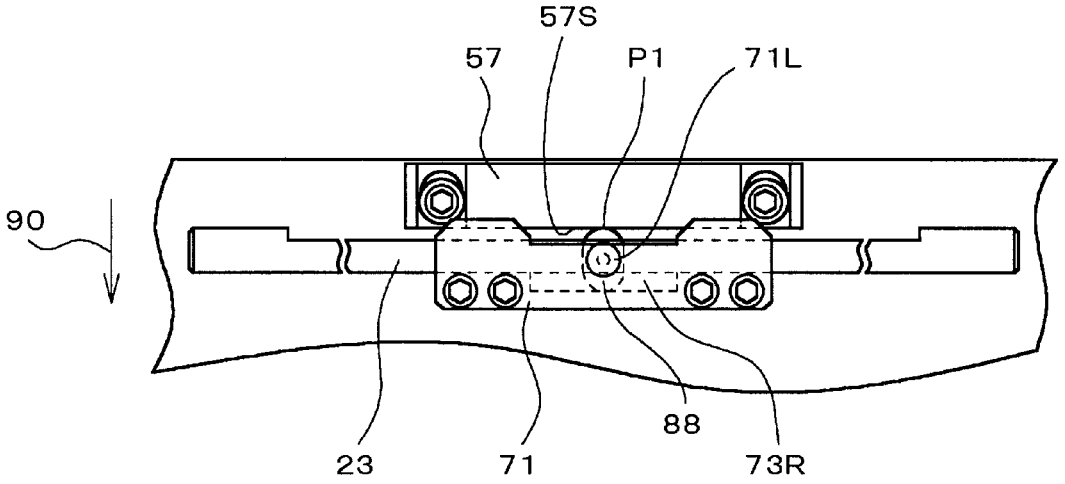
FIG. 11B is a plan view showing a condition that the movement of some of the spring bases is restricted by the clamping apparatus of the third embodiment.
Figure 13:
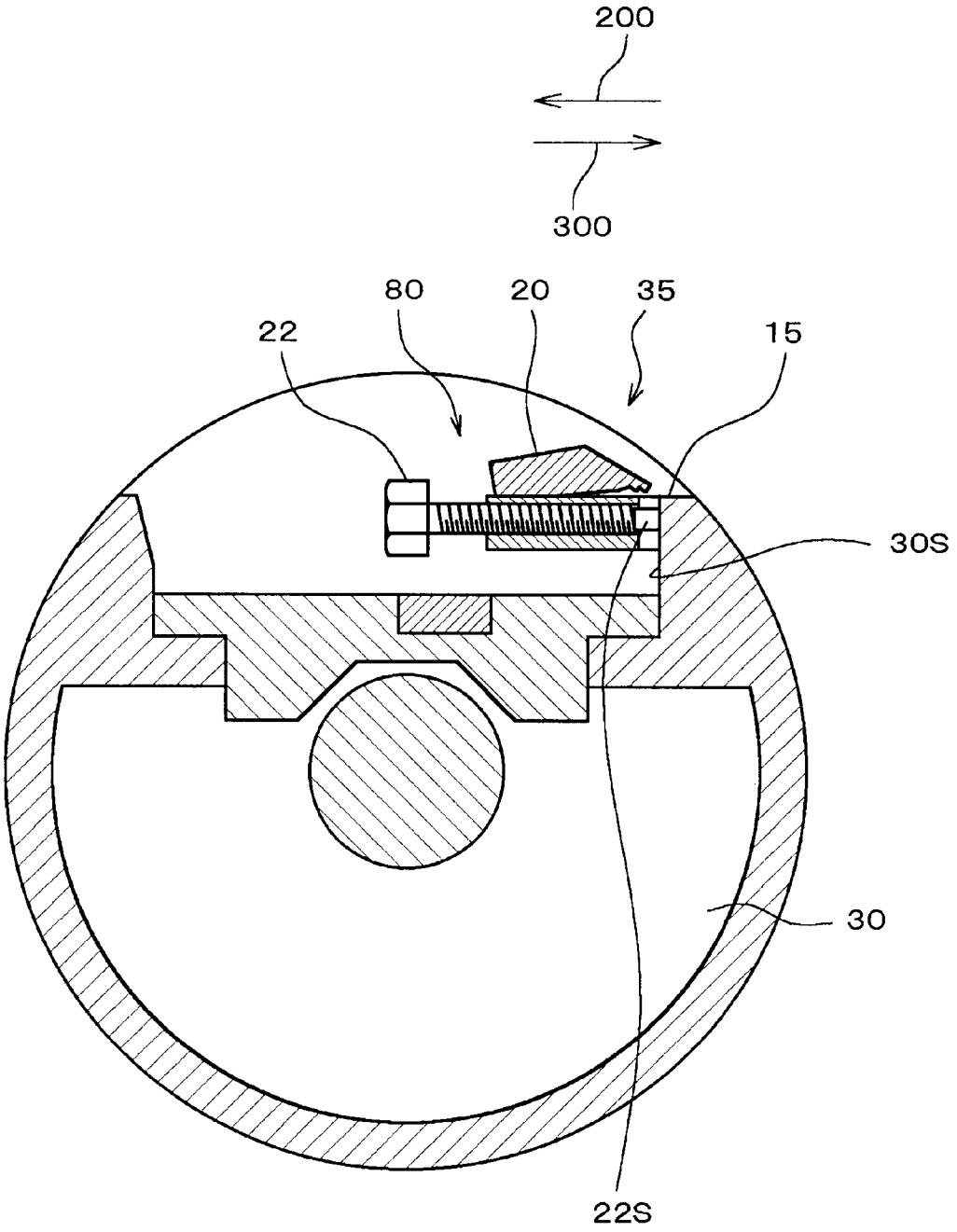
FIG. 13 is a sectional view showing a clamping apparatus of a prior art device.
Figure 14:
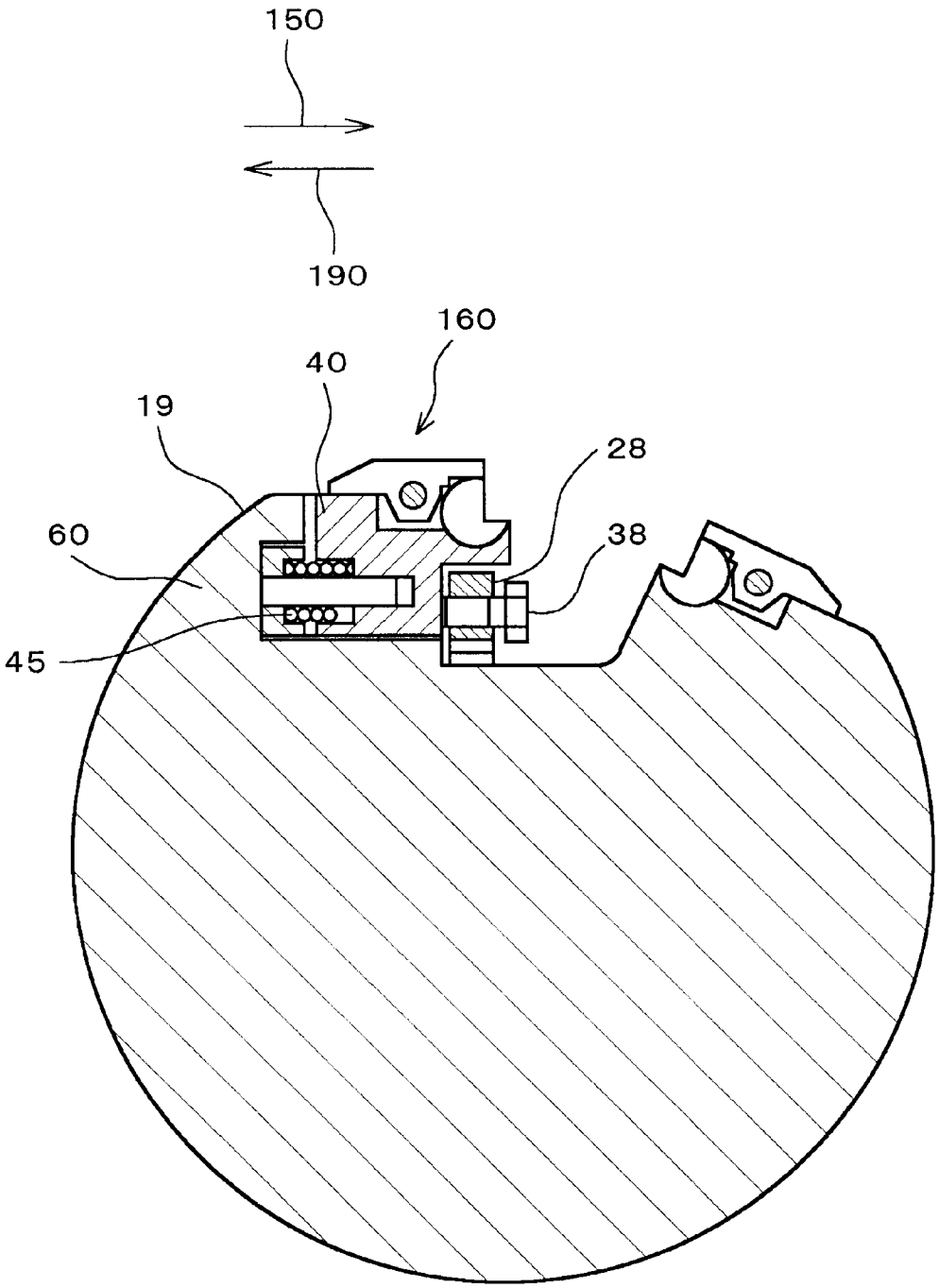
FIG. 14 is a sectional view showing another clamping apparatus of another prior art device.

On the contrary, the rotary lever 71L is rotated for 90 degrees from the condition shown in FIG. 11B when relatively high tension is applied to the plate 15. The point P2 of the rotary plate 88 is located at a position confronted with the inner surface 57S of the spring base 57 as shown in FIG. 11A by rotating the rotary lever 71L for 90 degrees.

As described above, the length of the radius L2 which starts from the central point 88C to the point P2 is shorter than that of the radius L1 which starts from the central point 88C to the point P1 (see FIG. 12). The movement of the spring base 57 in the direction of the arrow 90 is allowed without affecting the restriction made by the rotary plate 88.

Upon rotating the rotary lever 71L, the cam shaft 23 is rotated in the direction of the arrow 95 for 90 degrees similar to the condition shown in FIG. 4. By doing that, both the spring bases 50 and 52 are moved in the direction of the arrow 90. At the same time, the spring base 57 is moved in the direction of the arrow 90. In this way, all the tension generated by the coil springs provided to the spring bases 50, 57 and 52 are applied to the plate 15. Thus, relatively high tension is applied to the plate 15.

As described above, the movement of the spring base 57 toward the tail edge side clamping base 76 can either be allowed or be restricted by switching the contact or releasing the contact maintained between either of the point P1 or the point P2 of the rotary plate 88 and the inner surface 57 of the spring base 57 by rotating the rotary lever 71L in the clamping apparatus of this embodiment. Therefore, it is possible to apply adequate tension easily and quickly to the plate 15 depending on the materials of the plate 15.

Structure of the clamping apparatus in the present invention is not limited to the embodiments described earlier. Any other structure can be employed for realizing the characteristics of the present invention as long as the clamping apparatus capable of restricting movement of a part of the spring bases in the tensioning direction is capable of switching the contact or releasing the contact easily and quickly.

In the embodiments described earlier, adequate tension is applied to the plate 15 depending on the materials of the plate 15 by allowing or restricting the movement of a part (one) of the spring bases (three) in the tensioning direction. The part of the spring base is located so as to confront with the center of the tail edge side clamping base 76. In order to apply adequate tension to the plate 15, the movement of a part of the spring bases (for instance not less than two spring bases) may either be allowed or be restricted when more than three spring bases (not less than four spring bases) are provided in the present invention.

Further, a total of two coil springs 20 are provided in each of the spring bases 50 and the spring base 52, and a total of four coil springs 20 are provided in each of the spring base 51, the spring base 52 and the spring base 57 all of which are restricted in movement in the tensioning direction. Also, the number of the coil springs 20 provided in the spring bases 50 and the spring base 52 may be the same as that of the spring bases which are restricted in movement in the tensioning direction. Further, the number of the coil springs 20 provided into the spring bases 50 and the spring base 52 may also be less than that of the spring bases which are restricted in movement in the tensioning direction.

In addition, the contact maintained between the block convexes 72T and the base convexes 56T is released by engaging the block convexes 72T with the base concaves 56C formed on the spring base 56 in the second embodiment. It is possible to engage concave(s) formed on the first block similar to the base concaves 56C with convex(es) formed on the spring base 56 similar to the block convexes 72T. As a result, the contact maintained between the block convexes 72T and the newly formed convexes can also be released.

Although, the rotary plate 88 is provided to the tension selecting part 70 in the third embodiment, the rotary plate 88 can also be provided to the spring base 57. Either of the point P1 or the point P2 of the rotary plate 88 is contacted with a surface of the block concave 73R by its rotation.

Further, the rotary plate 88 is formed in semi-oval shape in the third embodiment. The rotary plate 88 can be formed in any other shape as long as the movement of the spring base 57 in the tensioning direction is allowed or is restricted reliably by contacting the point P1 of the rotary plate 88 with the inner surface 57S of the spring base 57 or by contacting the point P2 with the inner surface 57S. For instance, the rotary plate 88 can be formed in a polygon 188 such as a lengthwise hexagon or a lengthwise octagon or the like (see FIG. 15).

The clamping apparatus of a plate for a printing machine in the present invention is characterized in that, the second clamping part includes a holding part which holds the second edge of the plate, a plurality of pushing parts which push the holding part, such that the pushing parts push the holding part independently so as to move the holding part in a tensioning direction to close the plate with the cylinder surface of the plate cylinder, and a switching part which limits a pushing force of some of the pushing parts to the holding part or releases the limitation of the pushing force.

The pushing force applied by some of the pushing parts to the holding part can either be limited or be released. Therefore, it is possible for the clamping apparatus to apply adequate tension to the plate easily and quickly depending on the materials of the plate.

Also, the clamping apparatus of a plate for a printing machine in the present invention is characterized in that, the switching part limits the pushing force of some of the pushing parts to the holding part by restricting movement of some of the pushing parts in the tensioning direction, and the switching part releases the limitation of the pushing force by allowing the movement of some of the pushing parts in the tensioning direction. Thus, the pushing force of the pushing parts is limited or released by either restricting or releasing the movement of some of the pushing parts in the tensioning direction. Therefore, it is possible for the clamping apparatus to apply adequate tension to the plate easily and quickly depending on the materials of the plate.

Further, the clamping apparatus of a plate for a printing machine in the present invention is characterized in that, the pushing parts are composed of a central pushing part, a first adjacent pushing part and a second adjacent pushing part, and both the first adjacent pushing part and the second adjacent pushing part are positioned adjacent to both ends of the central pushing part, and the central pushing part pushes approximately at the center of the holding part, and both the first adjacent pushing part and the second adjacent pushing part push the holding part with substantially equal pushing force, and both the first adjacent pushing part and the second adjacent pushing part are moved together as one united body.

In this way, the holding part is pushed in the tensioning direction under symmetrical bases even when the holding part is pushed by either the central pushing part or both the first adjacent pushing part and the second adjacent pushing part. Therefore, it is possible for the clamping apparatus to apply equal tension to both the right hand side and the left hand side of the plate.

Still further, the clamping apparatus of a plate for a printing machine in the present invention is characterized in that, both a switching part convex and a pushing part convex are respectively provided to the switching part or the pushing parts either of which can be moved substantially perpendicularly to the tensioning direction. The movement of some of the pushing parts in the tensioning direction is restricted by contacting the switching part convex with the pushing part convex, and the movement of some of the pushing parts toward the tensioning direction is allowed by releasing the contact maintained between the switching part convex and the pushing part convex.

Thus, the pushing force applied by some of the pushing parts to the holding part can either be limited or be released only by switching the contact or releasing the contact maintained between the switching part convex and the pushing part convex. Therefore, it is possible for the clamping apparatus to apply adequate tension to the plate easily and quickly depending on the materials of the plate.

The clamping apparatus of a plate for a printing machine in the present invention is characterized in that, a rotary body capable of being rotated by centering around a central point is provided with either one of the switching part or the pushing parts, the rotary body has a first peripheral point and a second peripheral point on the periphery thereof. And the movement of some of the pushing parts in the tensioning direction is restricted by locating the first peripheral point of the rotary body so as to contact with the other one of the switching part or the pushing parts, and the movement of some of the pushing parts in the tensioning direction is allowed by locating the second peripheral point of the rotary body so as to confront with the other one of the switching part or the pushing parts.

Thus, the pushing force applied by some of the pushing parts to the holding part can either be limited or be released only by the rotating rotary body. Therefore, it is possible for the clamping apparatus to apply adequate tension to the plate easily and quickly depending on the materials of the plate.

While the invention has been described in its preferred embodiments, it is to be understood that the words which have been used are words of description rather than limitation and that changes within the purview of the appended claims can be made without departing from the true scope and spirit of the invention in its broader aspects.

What is claimed is:

1. A clamping apparatus of a plate to a plate cylinder for a printing machine comprising:

a first clamping part provided to the plate cylinder and fixing a first edge of the plate, and a second clamping part provided to the plate cylinder and fixing a second edge of the plate, the plate being rolled around a cylinder surface of the plate cylinder and the first edge thereof being fixed by the first clamping part, the second clamping part including a holding part which holds the second edge of the plate and a plurality of pushing parts which push the holding part, each of the pushing parts pushing the holding part independently so as to move the holding part in a tensioning direction to close the plate with the cylinder surface of the plate cylinder, and a switching part which imposes a limitation on the pushing force of some of the pushing parts to the holding part or which releases the limitation of the pushing force.

2. The clamping apparatus in accordance with claim 1, wherein the switching part limitation of the pushing force of said some of the pushing parts to the holding part restricts movement of said some of the pushing parts in the tensioning direction, and wherein the switching part releases the limitation of the pushing force by allowing the movement of said some of the pushing parts toward the tensioning direction.

3. The clamping apparatus in accordance with claim 2, wherein the pushing parts include a central pushing part, a first adjacent pushing part and a second adjacent pushing part, and wherein both the first adjacent pushing part and the second adjacent pushing part are positioned adjacent to ends of the central pushing part, and wherein the holding part has a center and the central pushing part pushes approximately the center of the holding part, and wherein both the first adjacent pushing part and the second adjacent pushing part push the holding part with substantially equal pushing force, and wherein both first adjacent pushing part and the second adjacent pushing part are moved together as one united body.

4. The clamping apparatus in accordance with claim 2, wherein the switching part includes a switching part convex, and wherein the pushing part includes a pushing part convex, and wherein the movement of said some of the pushing parts in the tensioning direction is restricted by contacting the switching part convex with the pushing part convex, and wherein the movement of said some of the pushing parts in the tensioning direction is allowed by releasing the contact maintained between the switching part convex and the pushing part convex, and wherein at least one of the switching part and the pushing part can be moved substantially perpendicular to the tensioning direction, and wherein contact maintained between the switching part convex and the pushing part convex or release of the contact is selected by changing movement of one of the switching part and the pushing part.

5. A The clamping apparatus in accordance with claim 4, wherein the pushing part includes a concave formed at a position adjacent to the pushing part convex of the pushing part, and wherein movement of said some of the pushing parts in the tensioning direction is allowed by releasing the contact maintained between the switching part convex and the pushing part convex as a result of engaging the switching part convex with the concave formed on the pushing part.

6. The clamping apparatus in accordance with claim 4, wherein the switching part includes a concave formed at a position adjacent to the switching part convex of the switching part, and wherein movement of said some of the pushing parts in the tensioning direction is allowed by releasing the contact maintained between the switching part convex and the pushing part convex as a result of engaging the pushing part convex with the concave formed on the switching part.

7. The clamping apparatus in accordance with claim 2, wherein a rotary body capable of being rotated around a central point is provided to one of the switching part and the pushing part, the rotary body has a first peripheral point and a second peripheral point on a periphery thereof, and wherein a first length from the central point to the first peripheral point is longer than a second length from the central point to the second peripheral point, and wherein the movement of the said some of the pushing parts toward the tensioning direction is restricted by locating the first peripheral point of the rotary body so as to contact with the other one of the switching part and the pushing part, and wherein the movement of said some of the pushing parts in the tensioning direction is allowed by locating the second peripheral point of the rotary body so as to confront with the other one of the switching part and the pushing part, and wherein contact between the first peripheral point and the other one of the switching part and the pushing part or the confrontation of the second peripheral point with the other one of the switching part and the pushing part is selected by rotating the rotary body.

8. The clamping apparatus in accordance with claim 7, wherein the rotary body is formed in a semi-oval shape.

9. A clamping apparatus of a plate for a printing machine in accordance with claim 7, wherein the rotary body is formed in a polygon shape.

* * * * *